US009266631B2

(12) United States Patent
Chen

(10) Patent No.: US 9,266,631 B2
(45) Date of Patent: Feb. 23, 2016

(54) CUTTING-OFF STRUCTURE OF A PACKER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 62 days.

(21) Appl. No.: 14/298,376

(22) Filed: Jun. 6, 2014

(65) Prior Publication Data

US 2015/0353217 A1 Dec. 10, 2015

(51) Int. Cl.
*B65B 13/02* (2006.01)
*B65B 13/16* (2006.01)

(52) U.S. Cl.
CPC ..... *B65B 13/025* (2013.01); *B65B 13/16* (2013.01)

(58) Field of Classification Search
CPC ..... B65B 13/16; B65B 13/04; B65B 13/025; B65B 13/24; B65B 13/265; B65B 13/285; B65B 13/305
USPC ..... 100/6, 29, 30, 32, 33 R, 33 PB, 94; 140/93.2, 93.4; 53/582, 589, 592; 156/579
See application file for complete search history.

(56) References Cited

U.S. PATENT DOCUMENTS

| | | | | |
|---|---|---|---|---|
| 4,252,158 | A * | 2/1981 | McDade | B65B 13/025 140/123.6 |
| 6,698,460 | B2 * | 3/2004 | Marsche | B65B 13/185 140/150 |
| 6,962,108 | B1 * | 11/2005 | Chen | B65B 13/025 100/29 |
| 7,100,499 | B2 * | 9/2006 | Chen | B65B 13/025 100/282 |
| 2005/0284534 | A1 * | 12/2005 | Chen | B65B 13/025 140/123.6 |
| 2009/0158942 | A1 * | 6/2009 | Barlosov | B65B 13/025 100/6 |

* cited by examiner

*Primary Examiner* — Jimmy T Nguyen
(74) *Attorney, Agent, or Firm* — Ming Chow; Sinorica, LLC

(57) ABSTRACT

A cutting-off structure of a packer includes a main body having one side provided with a strap-cutting device. The strap-cutting device has a cutter tube formed with an application section and a combination section, and the application section is provided with a first strap-cutting block and a second strap-cutting block and formed with a strap-guiding groove and a strap-cutting opening. The first strap-cutting block is disposed with a strap-cutting surface at one side opposite to the strap-cutting opening for threadably assembling a cutting unit thereon, which can be assembled with or disassembled from the strap-cutting surface. By so designing, the strap-cutting surface of a packer in the present invention enables a user to cut off packing straps quickly and accurately through the strap-cutting opening and the replaceable cutting unit, convenient in use and able to lower cost.

8 Claims, 9 Drawing Sheets

CUTTING-OFF STRUCTURE OF A PACKER

BACKGROUND OF THE INVENTION

1. Field of the Invention

This invention relates to a cutting-off structure of a packer, particular to one containing a cutting unit provided with a replaceable blade to be pressed downward for cutting off packing straps.

2. Description of the Prior Art

A conventional packer, as shown in FIGS. 1 and 2, includes a cutting device 1, a clamp-stop device 2 and a strap-pressing device 3 that are assembled on a base 4. A control lever 6 is pivotally provided at a location of a handle 5 of the base 4 and axially connected with the clamp-stop device 3. The cutting device 1 of the conventional packer, as shown in FIG. 2, contains a cutter sleeve 7 set therein with a cutter 8 having its right side formed with a cutting edge 9 and its left side firmly assembled with a fixed pin 10, and the cutter sleeve 7 has its circumferential edge of another end cut with a slot 11. In using, a user can press down the control lever 6 to have its front end moving upward to actuate the fixed pin 10 to turn and drive the cutter 8 to rotate for cutting off the packing strap placed in the slot 11 of the cutter sleeve 7.

However, after the cutter 8 is employed to cut off packing straps for a long period of time, the cutter 8 will become dull and wear off and it needs to replace the whole cutter 8, and the cutter 8 of the conventional packer is complicated in manufacturing and difficult in processing and further, the conventional packer is hard to be assembled. In view of the defects mentioned above, the inventor of this invention thinks that the conventional packer is necessary to be ameliorated and hence devises this invention.

SUMMARY DESCRIPTION OF DRAWINGS

This invention is devised to offer a cutting-off structure of a packer, which is provided with a strap-cutting device with a replaceable blade, able to lower cost and let a user to cut off packing straps accurately. The cutting-off structure of a packer in the present invention includes a main body having two sides bored with three juxtaposed through holes for orderly receiving a strap-cutting device, a strap-winding device and a strap-pressing device and having another side installed with a power device that is connected with the strap-winding device. The strap-cutting device contains a cutter tube formed with an application section and a combination section. The combination section is correspondingly received in one of the through holes, while the application section is protruded out of one side of the main body and formed with a first strap-cutting block and a second strap-cutting block, having a strap-guiding groove formed between the first strap-cutting block and the second strap-cutting block. The first strap-cutting block is recessed and disposed with a strap-cutting opening at one side opposite to the strap-cutting groove, and a strap-cutting surface is defined by the first strap-cutting block and the strap-cutting opening for a cutting unit to be assembled thereon.

The cutting-off structure of a packer of this invention is assembled thereon with a packing strap, which has one end fixed by the strap-pressing device and another end wound around an article to be packed and then, the packing strap is inserted through the strap-guiding groove and then wound up and fixed by the strap-winding device. When the packing strap is to be cut, a user can make use of the cutting unit to cut off the packing strap through the strap-cutting opening and the strap-cutting surface. In addition, the cutting unit of this invention is replaceable, able to be assembled with or disassembled from the strap-cutting surface of the first strap-cutting block. Therefore, the cutting unit of the strap-cutting device of this invention can conveniently be replaced, able to lower cost and let a user to cut off the packing strap accurately and quickly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
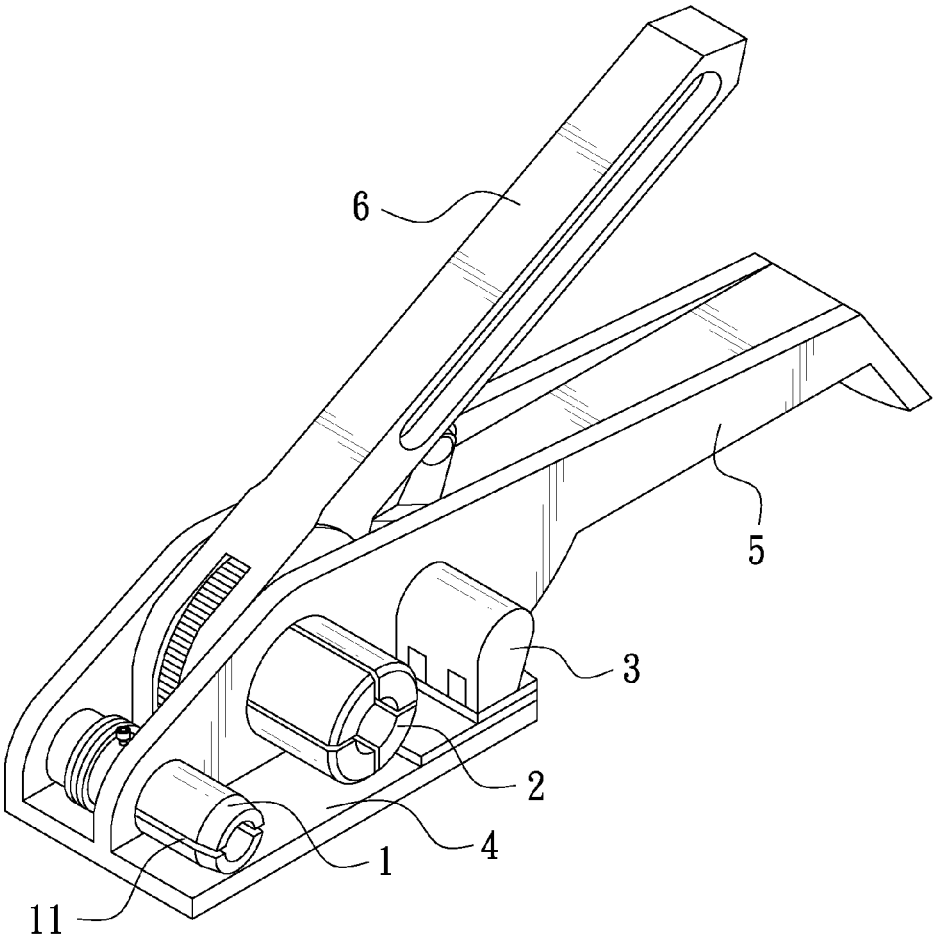
FIG. 1 PRIOR ART
FIG. 1 is a perspective view of a conventional packer.
Figure 2:
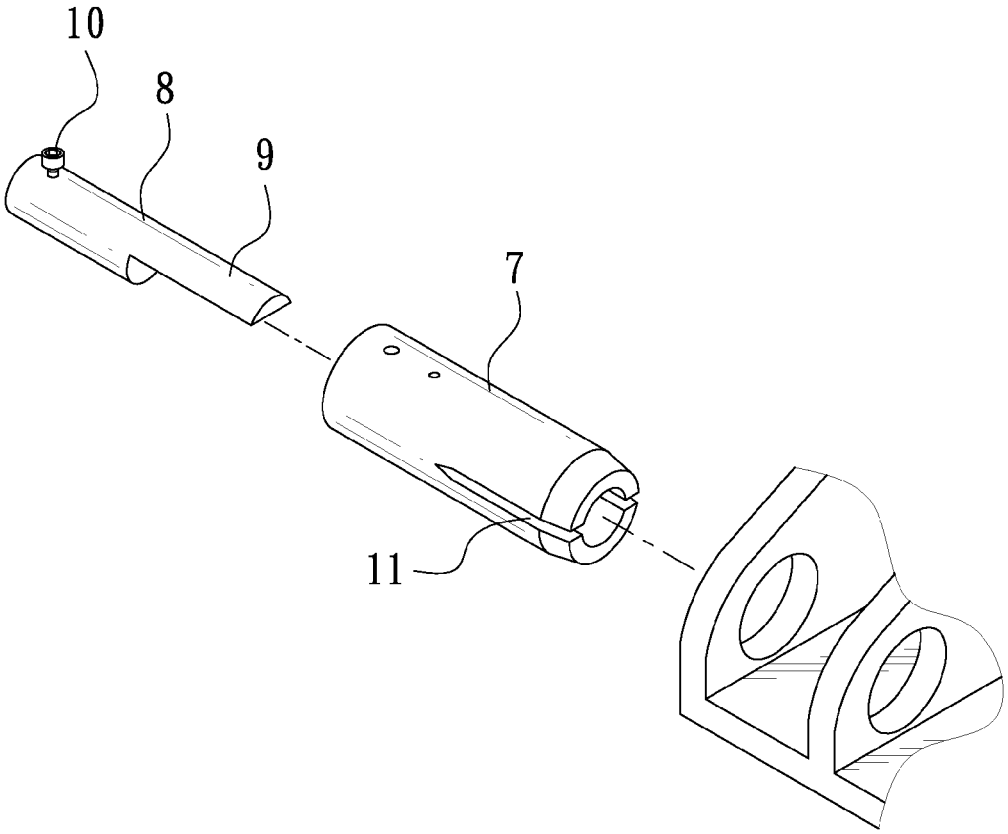
FIG. 2 PRIOR ART
FIG. 2 is a partial exploded perspective view of the conventional packer.
Figure 3:
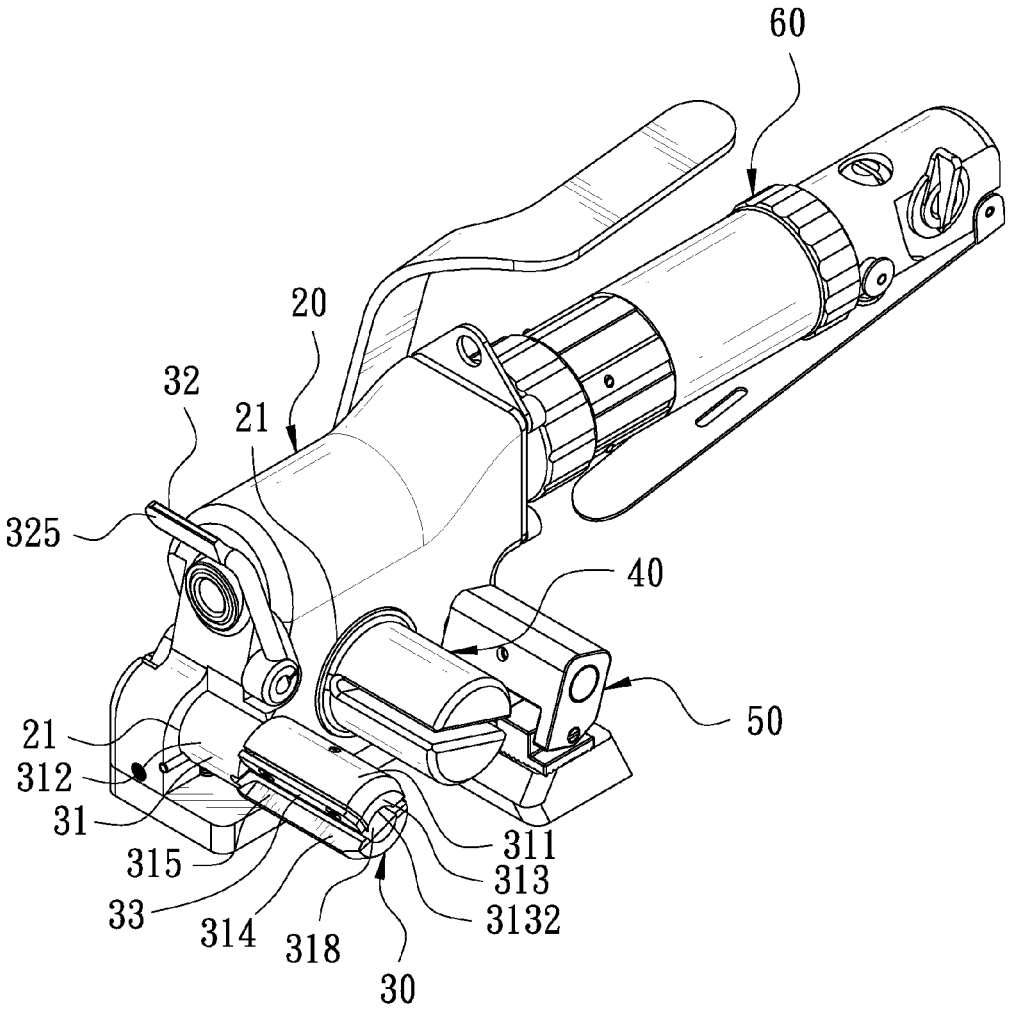
FIG. 3 is a perspective view of a first preferred embodiment of a cutting-off structure of a packer in the present invention.
Figure 4:
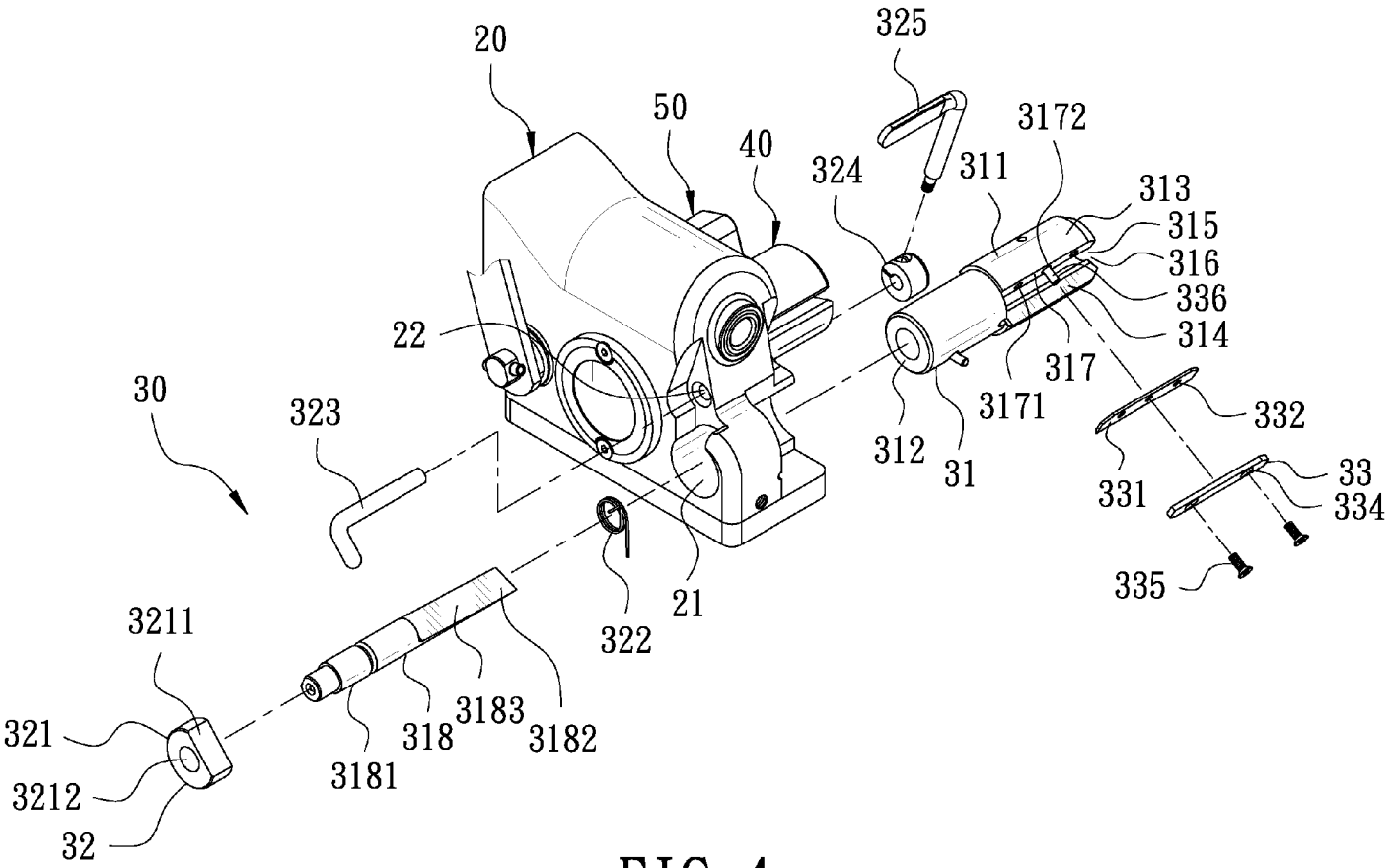
FIG. 4 is a partial exploded perspective view of the first preferred embodiment of the cutting-off structure of the packer in the present invention.

A first preferred embodiment of a cutting-off structure of a packer in the present invention, as shown in FIGS. 3 and 4, includes a main body 20, a strap-cutting device 30, a strap-winding device 40, a strap-pressing device 50 and a power device 60 that is provided at one side of the main body 20 and connected with the strap-winding device. In this preferred embodiment, the internal structure of the strap-winding device 40 and the strap-pressing device 50 and the power device 60 is the same as the conventional structure so it is unnecessary to go into details.

The main body 20 has two sides bored with three juxtaposed through holes 21 arranged horizontally for orderly receiving the strap-cutting device 30, the strap-winding device 40 and the strap-pressing device 50 and has another side provided with a shaft hole 22 at a location near an upper side of one through hole 21.

Figure 5:
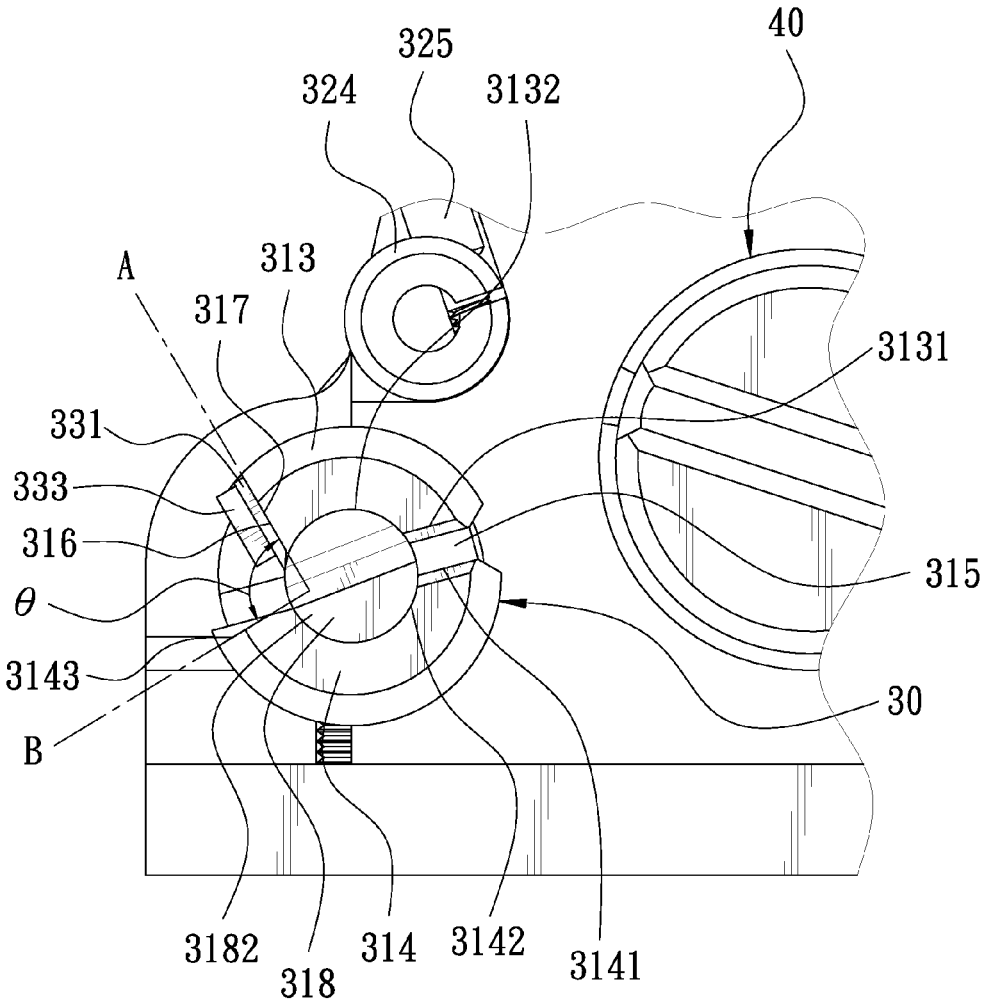
FIG. 5 is a plane view of the first preferred embodiment of a strap-cutting device of the packer in the present invention.

The strap-cutting device 30 consists of a cutter tube 31 and an interacting device 32. The cutter tube 31 is formed with an application section 311 and a combination section 312, and the combination section 312 is to be correspondingly combined with the through hole 21 of the main body 20 while the application section 311 is protruded out of one side of the main body 20. The application section 311 is formed with a first strap-cutting block 313 and a second strap-cutting block 314, having a strap-guiding groove 315 formed between the first strap-cutting block 313 and the second strap-cutting block 314. Referring to FIGS. 4 and 5, the first strap-cutting block 311 has one side, opposite to the strap-guiding groove 315, formed into a first sidewall 3131 having its front section recessed and provided with a first circular arc groove 3132. The second strap-cutting block 314 is formed with a second sidewall 3141 opposite to the first sidewall 3131 of the first strap-cutting block 313 and having its intermediate section recessed and formed with a second circular arc groove 3142, which has one side formed into a guide slant 3143. The first sidewall 3131 and the second sidewall 3141 are corresponding with each other and provided in parallel horizontally.

In addition, the first strap-cutting block 313 is disposed with a strap-cutting opening 316 at one side opposite to the strap-guiding groove 315, and a strap-cutting surface 317 is defined by the first strap-cutting block 313 opposite to the strap-cutting opening 316. The second strap-cutting block 314 is formed with a guide slant 3143 at one side opposite to the location of the strap-cutting opening 316. The strap-cutting surface 317 of the first strap-cutting block 313 is bored with at least two threaded holes 3171 and a fixing hole 3172 between the two threaded holes 3171. A cutting unit 33 is threadably secured on the strap-cutting surface 317, containing a blade 331 and a blade press plate 333 to be superposed on one side of the blade 331, which has another side closely attached to the strap-cutting surface 317. The blade 331 is bored with a plurality of inert holes 332 respectively corresponding with the two threaded holes 3171 and the fixing hole 3172 of the strap-cutting surface 317, and the blade press plate 333 is bored with a plurality of insert holes 334 corresponding to the two threaded holes 3171 and the fixing hole 3172. Plural screws 335 are correspondingly inserted through the insert holes 334 of the blade press plate 333 and through the insert holes 332 of the blade 331 and then screwed with threaded holes 3171, and an insert pin 336 is orderly and correspondingly inserted through the insert hole 334 of the blade-pressing plate 333 and through the insert hole 332 of the blade 331 and then secured in the fixing hole 3172 of the strap-cutting surface 317 to firmly position both the blade 331 and the blade press plate 333 on the strap-cutting surface 317 of the first strap-cutting block 313.

Referring to FIG. 5, in this preferred embodiment, a first axis (A) is defined by the first strap-cutting block 313 along the strap-cutting surface 317, while a second axis (B) is defined by the second strap-cutting block 314 along the guide slant 3143, with an angle of about 90 degrees formed between the first axis (A) and the second axis (B). The cutter tube 31 has its central portion axially and pivotally mounted with a cutter core 318 formed with a cutter rod 3181 corresponding to the combination section 312 of the cutter tube 31. The cutter rod 3181 has one end inserted in the combination section 312 of the cutter tube 31 and another end extending to form a press block 3182 corresponding with the application section 311 of the cutter tube 31. The press block 3182 is positioned in the strap-guiding groove 315, having one side closely contacting with the second circular arc groove 3142 and another side, opposite to the first strap-cutting block 313, formed into an oblique plane 3183 slanting from the cutter rod 3181 toward the cutter tube 31.

Referring to FIG. 4, the interacting device 32 is provided with a cutter core ring 321 and a torsional spring 322. The cutter core ring 321 has one side formed into a tapered plane 3211 and a central portion bored with a shaft hole 3212, with the shaft hole 3212 and the torsional spring 322 correspondingly fitted at one end of the cutter rod 3181. The cutter core ring 321 is positioned at the outer side of the torsional spring 322, which has one end pressed on the tapered plane 3211 of the cutter core ring 321 to make the cutter rod 3181 abut against the second strap-cutting block 314 and have one side of the press block 3182 closely attached to one side of the second strap-cutting block 314. The interacting device 32 further contains an L-shaped cutter core-pushing rod 323, which has one end pressed on the tapered plane 3211 and another end inserted through the shaft hole 22 of the main body 20 and fitted thereon with a cutter core-pushing rod ring 324, which is fixed thereon with a handle 325.

Figure 6:
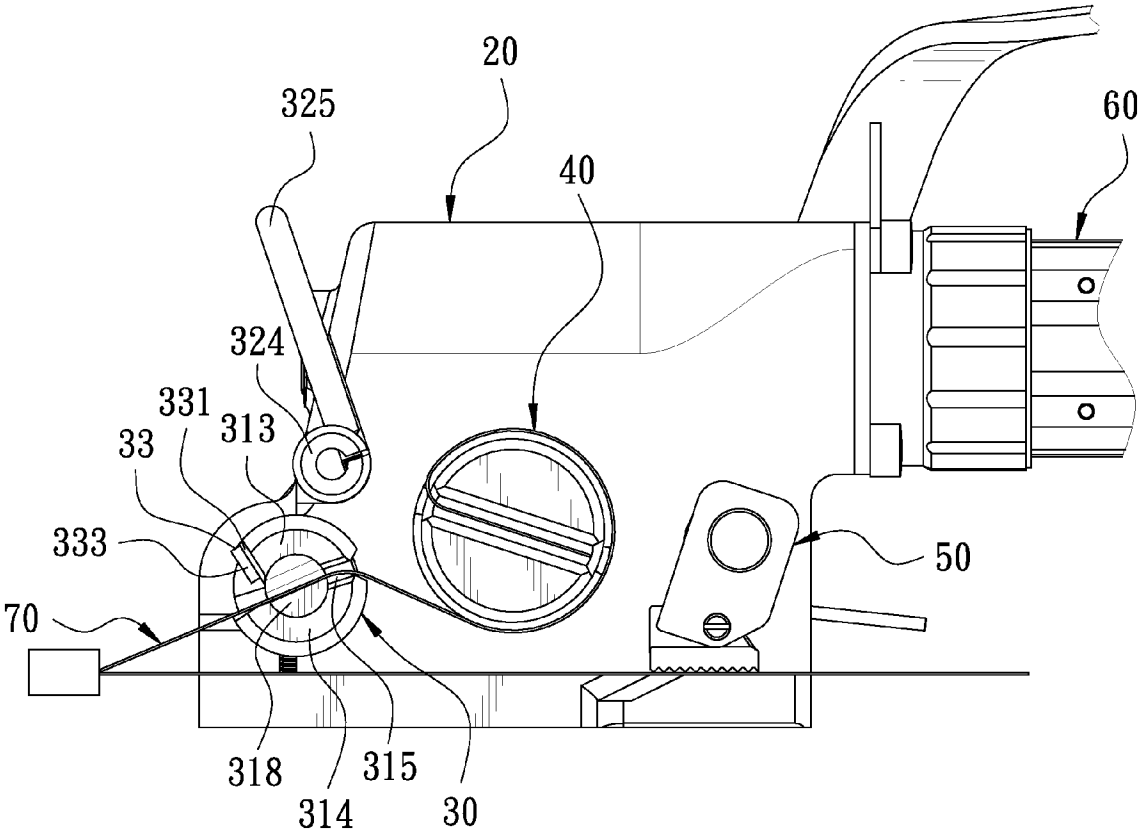
FIG. 6 is a schematic view of the first preferred embodiment of the cutting-off structure of the packer in the present invention, illustrating a state before the packing strap is cut off.
Figure 7:
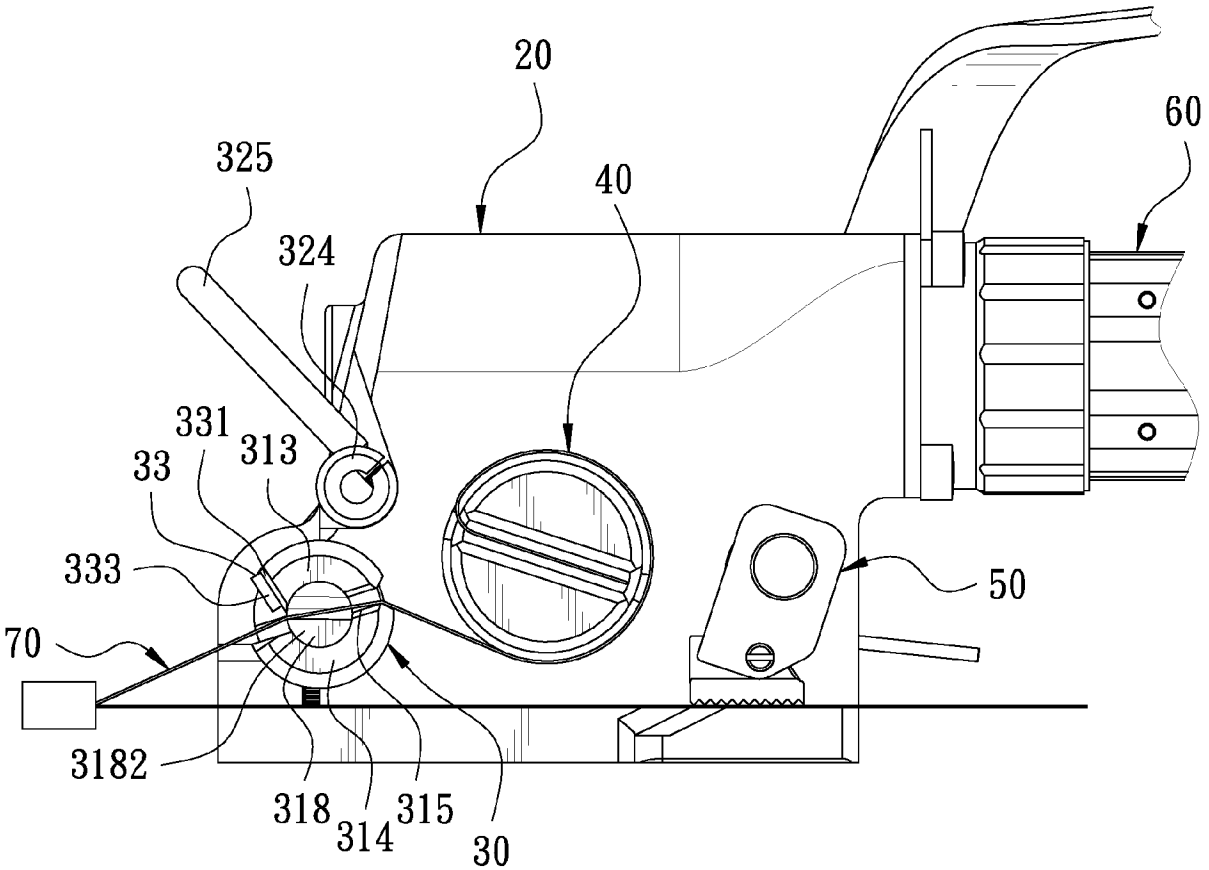
FIG. 7 is a schematic view of the first preferred embodiment of the cutting-off structure of the packer in the present invention, illustrating a state when the packing strap is being cut off.

Referring to FIGS. 4, 6 and 7, in using, firstly, a packing strap 70 is assembled on the main body 20, having one end secured by the strap-pressing device 50 and another end wound around an article to be packed and then orderly inserted through the strap-guiding groove 315 and wound and fixed in position by the strap-winding device 40. Next, the power device 60 is started to actuate the strap-winding device 40 to wind up the packing strap 70 to enable the packing strap 70 to bind the article with tightness. When the article is tightly bound by the packing strap 70, the handle 325 of the strap-cutting device 30 can be controlled by a user to turn and actuate the cutter core-pushing rod 323 to rotate and press the tapered plane 3211 of the cutter core ring 321 for turning around the cutter core ring 321. At this time, referring to FIG. 7, the cutter core ring 321 will actuate the cutter rod 3181 to rotate together to have one side of the press block 3182 pushing up the lower side of the packing strap 70 to let the upper side of the packing strap 70 cut by the blade 331 of the cutting unit 33, thus able to cut off the packing strap 70.

Referring to FIGS. 4 and 5, since the first strap-cutting block 313 has one side formed with the strap-cutting opening 316, and the blade 331 and the blade-pressing plate 333 of the cutting unit 33 are fixed on the strap-cutting surface 317 by means of the screws 335; therefore, when the blade 331 is used for cutting the packing strap 70 for a long period of time and becomes dull and wears out, a user can unscrew the screws 335 and remove the insert pin 336 for replacing the blade 331 with a new one. After the blade 331 is replaced, the insert pin 336 is orderly inserted through the insert hole 334 of the blade-pressing plate 333 and through the insert hole 332 of the blade 331 and then secured in the fixing hole 3172 of the strap-cutting surface 317, and the screws 335 are inserted through the insert holes 334 of the blade-pressing plate 333 and through the insert holes 332 of the blade 331 and then threadably fixed in the threaded hole 3171 for stably positioning both the blade 331 and the blade-pressing plate 333 on the strap-cutting surface 317 of the first strap-cutting block 313. Referring to FIG. 5, the second strap-cutting block 314 is formed with the guide slant 3143 at one side opposite to the strap-cutting opening 316 so that the strap 70 can smoothly pass through the strap-guiding groove 315 and, in cooperation with the angle (θ) formed between the first axis (A) and the second axis (B), when one side of the press block 3182 is actuated to push up the lower side of the packing strap 70, the packing strap 70 can be cut off quickly. Thus, the strap-cutting surface 317 of the first strap-cutting block 313 can be disassembled from or assembled with the cutting unit 33 via the strap-cutting opening 316. Compared with the cutter 8 of the conventional packer, the cutting unit 33 of this invention can be replaced conveniently, able to lower cost and let a user to cut off packing straps accurately and quickly.

Figure 8:
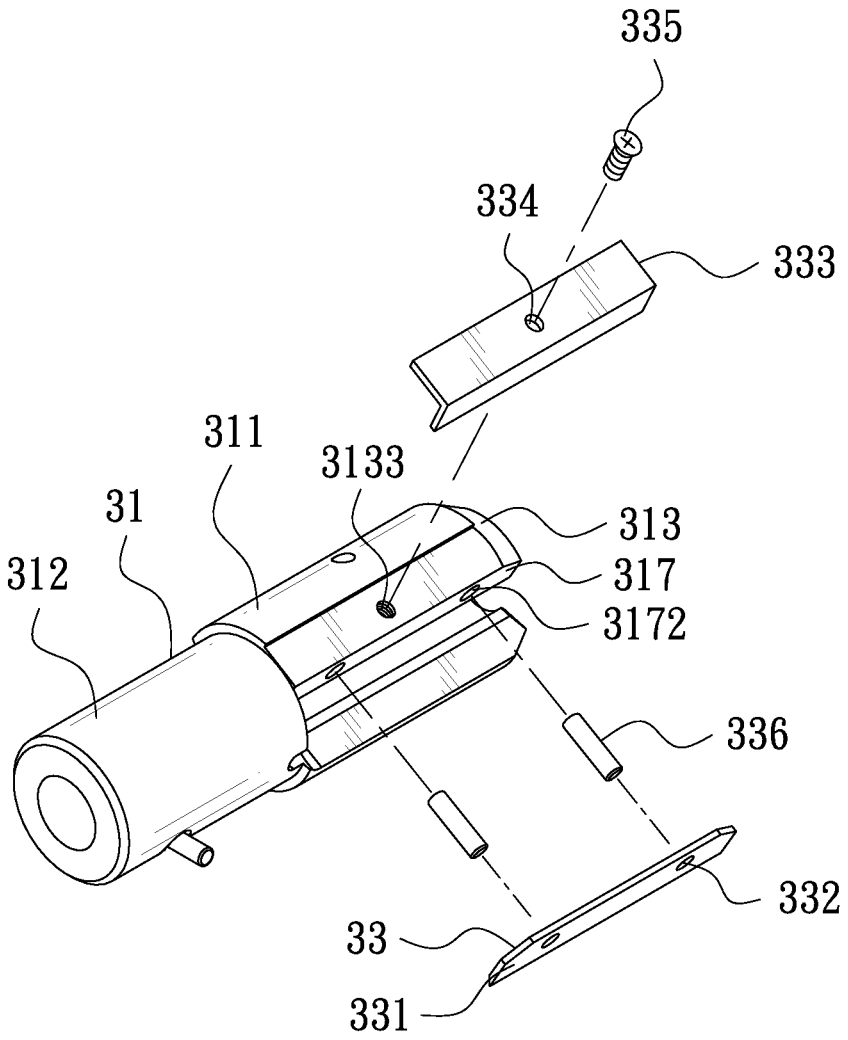
FIG. 8 is a partial exploded perspective view of a second preferred embodiment of the cutting-off structure of the packer in the present invention.

A second preferred embodiment of a cutting-off structure of a packer in the present invention, as shown in FIG. 8, is almost the same in structure and members as those of the first preferred embodiment, except the structure of the first strap-cutting block 313 and the cutting unit 33. In the second preferred embodiment, the blade-pressing plate 333 of the cutting unit 33 is L-shaped and has its topside bored with an insert hole 334, and the first strap-cutting block 313 has its outer side provided with a threaded hole 3133 corresponding to the insert hole 334. Further, the strap-cutting surface 317 of the first strap-cutting block 313 is bored with two fixing holes 3172, which are the same as the fixing hole 3172 of the first preferred embodiment, and the blade 331 is bores with two insert holes 332 corresponding to the fixing holes 3172. In assembly, the blade 331 is closely attached to the strap-cutting surface 317, and two insert pins 336 are correspondingly inserted through the two insert holes 332 of the blade 331 and then secured in the fixing holes 3172 of the strap-cutting surface 317, letting the blade 331 positioned at a predetermined location and then, the blade-pressing plate 333 has its inner side closely attached to and pressed on the outer side of the blade 331 and finally, a screw 335 is inserted through the insert hole 334 of the blade-pressing plate 333 and then screwed in the threaded hole 3133 of the first strap-cutting block 313 for firmly positioning the blade 331 on the first strap-cutting block 313. Thus, the cutting unit 33 of this invention can conveniently be replaced via the L-shaped blade-pressing plate 333, able to lower cost and cut off packing straps quickly.

Figure 9:
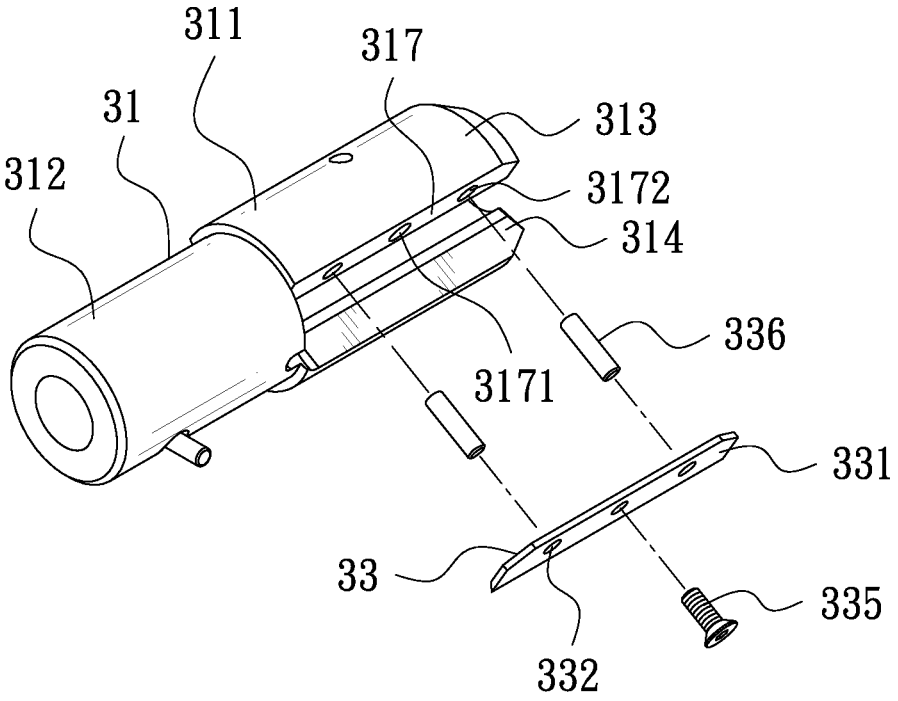
FIG. 9 is a partial exploded perspective view of a third preferred embodiment of the cutting-off structure of the packer in the present invention.

A third preferred embodiment of cutting-off structure of a packer in the present invention, as shown in FIG. 9, is different from the first preferred embodiment in structure of the first strap-cutting block 313 and the cutting unit 33. In the third preferred embodiment, the cutting unit 33 is only provided with a blade 331, and the strap-cutting surface 317 of the first strap-cutting block 313 is bored with two fixing holes 3172 and a threaded hole 3171 located between the two fixing holes 3172. Further, the blade 331 is disposed with a plurality of insert holes 332 corresponding to the fixing holes 3172 and the threaded hole 3171. In assembly, two insert pins 336 are correspondingly inserted through the insert holes 332 of the blade 331 and then inserted in the fixing hole 3172 of the strap-cutting surface 317 and lastly, a screw 335 is inserted through the central insert hole 332 of the blade 331 and then threadably secured in the threaded hole 3171 for stably positioning the blade 331 on the strap-cutting surface 317 of the first strap-cutting block 313, thus, equally attaining the same efficacy of stably positioning and conveniently replacing the blade 331 as that described in the first and the second preferred embodiments and hence able to lower cost.

While the preferred embodiments of the invention have been described above, it will be recognized and understood that various modifications may be made therein and the appended claims are intended to cover all such modifications that may fall within the spirit and scope of the invention.

What is claimed is:

1. A cutting-off structure of a packer comprising, a main body, said main body provided with a strap-cutting device, a strap-winding device and a strap-pressing device, said main body having one side installed with a power device connected with said strap-winding device wherein, said strap-cutting device formed with a cutter tube, said cutter tube formed with an application section and a combination section, said combination section combined with said main body, said application section protruding out of one side of said main body, said application section composed of a first strap-cutting block and a second strap-cutting block, a strap-guiding groove formed between said first strap-cutting block and said second strap-cutting block, said first strap-cutting block recessed and provided with a strap-cutting opening at one side opposite to said strap-guiding groove, a strap-cutting surface defined by said first strap-cutting block opposite to said strap-cutting opening, said strap-cutting surface fixed thereon with a cutting unit; and packing straps able to be cut off through said strap-cutting opening and said cutting unit, said cutting unit easy to be assembled with or disassembled from said strap-cutting surface, said cutting unit being replaceable and hence able to economize cost.

2. The cutting-off structure of a packer as claimed in claim 1, wherein said cutter tube has a central portion axially and pivotally mounted with a cutter core, said cutter core formed with a cutter rod corresponding to said combination section of said cutter tube, said cutter rod having one end formed with a press block corresponding to said application section of said cutter tube, said press block positioned in said strap-guiding groove.

3. The cutting-off structure of a packer as claimed in claim 1, wherein said second strap-cutting block is formed with a guide slant at one side opposite to said strap-cutting opening.

4. The cutting-off structure of a packer as claimed in claim 3, wherein an angle is defined by said strap-cutting surface and said guide slant, and said angle is about 90 degrees.

5. The cutting-off structure of a packer as claimed in claim 1, wherein said cutting unit is composed of a blade and a blade-pressing plate, said blade having one side attached to said strap-cutting surface, said blade-pressing plate pressing another side of said blade.

6. The cutting-off structure of a packer as claimed in claim 5, wherein said strap-cutting surface of said strap-cutting device is provided with at least two threaded holes, and said blade and said blade-pressing plate are respectively bored with a plurality of insert holes corresponding to said threaded holes, plural screws correspondingly inserted through said insert holes and then threadably secured in said threaded hole for fixing both said blade and said blade-pressing plate on said strap-cutting surface of said first strap-cutting block.

7. The cutting-off structure of a packer as claimed in claim 2, wherein said press block of said cutter core is formed with an oblique plane at one side opposite to said first strap-cutting block.

8. The cutting-off structure of a packer as claimed in claim 1, wherein said first strap-cutting block is formed with a first sidewall at one side opposite to said strap-guiding groove, and said second strap-cutting block is formed with a second sidewall facing said first sidewall, said first sidewall and said second sidewall provided oppositely and horizontally.

* * * * *